US008713865B2

(12) United States Patent
Hall

(10) Patent No.: US 8,713,865 B2
(45) **Date of Patent: *May 6, 2014**

(54) SHRAPNEL CONTAINMENT SYSTEM AND METHOD FOR PRODUCING SAME

(75) Inventor: Bruce S. Hall, Salisbury, MD (US)

(73) Assignee: Life Shield Engineered Systems, LLC, Salisbury, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/617,122

(22) Filed: Sep. 14, 2012

(65) Prior Publication Data

US 2013/0008129 A1 Jan. 10, 2013

Related U.S. Application Data

(63) Continuation of application No. 10/510,691, filed as application No. PCT/US2004/010488 on Apr. 6, 2004, now Pat. No. 8,316,613.

(60) Provisional application No. 60/460,422, filed on Apr. 7, 2003.

(51) Int. Cl.

| | |
|---|---|
| ***E06B 5/10*** | (2006.01) |
| ***E06B 5/12*** | (2006.01) |
| ***E04B 2/90*** | (2006.01) |
| ***E04B 2/72*** | (2006.01) |

(52) U.S. Cl.

USPC ..... 52/203; 52/202; 52/DIG. 12; 52/506.01

(58) Field of Classification Search

CPC ..... E06B 5/10; E06B 5/12; E04B 2/90

USPC ..... 52/473, 203, 202, 506.01, 405.1, 52/DIG. 12, 745.16, 745.2, 745.06, 741.3, 52/741.4; 109/80, 83, 79, 78; 89/36.04, 89/36.05

See application file for complete search history.

(56) References Cited

U.S. PATENT DOCUMENTS

| | | | | |
|---|---|---|---|---|
| 230,228 | A | 7/1880 | Boyd | |
| 1,444,405 | A | 2/1923 | Wagemaker | |
| 1,871,571 | A * | 8/1932 | Weber | 52/3 |

(Continued)

FOREIGN PATENT DOCUMENTS

| | | |
|---|---|---|
| FR | 2 360 420 AI | 3/1978 |
| GB | 2007256 A | 5/1979 |

(Continued)

OTHER PUBLICATIONS

International Application No. PCT/USO4/010488—PCT Written Opinion of the International Searching Authority and International Search Report mailed Dec. 10, 2004.

(Continued)

*Primary Examiner* — Phi A

(74) *Attorney, Agent, or Firm* — Miles & Stockbridge, P.C.; David R. Schaffer

(57) ABSTRACT

A shrapnel containment system is provided which is adapted to be installed at an interior of a building wall to contain shrapnel from a blast, the system including a panel made of a layer of elastomeric material and fastener elements to fasten the layer to a wall of a structure, with the panel optionally including a fabric reinforcing layer. A method for producing the panel is also provided.

20 Claims, 2 Drawing Sheets

(56) References Cited

U.S. PATENT DOCUMENTS 1,990,656 A 2/1935 Kotrbaty
2,104,872 A 1/1938 Levy
2,235,001 A 3/1941 Allen
2,718,829 A 9/1955 Seymour et al.
2,806,277 A 9/1957 Hand et al.
3,029,172 A 4/1962 Glass
3,235,039 A 2/1966 O'Donnell
3,444,033 A 5/1969 King
3,522,140 A 7/1970 Hartzell
3,648,613 A 3/1972 Cunn
3,648,615 A 3/1972 Wilkaitis
3,649,324 A 3/1972 Payne
3,703,201 A 11/1972 Musyt et al.
3,736,715 A 6/1973 Krumwiede
3,801,416 A 4/1974 Gulbierz
3,866,242 A 2/1975 Slagel
3,962,976 A 6/1976 Kelsey
4,062,347 A 12/1977 Jensen
4,104,842 A 8/1978 Rockstead et al.
4,125,984 A 11/1978 Jonas
4,139,591 A 2/1979 Jurisich
4,175,357 A 11/1979 Goldhaber
4,185,437 A 1/1980 Robinson
4,226,071 A 10/1980 Bennett
4,253,288 A 3/1981 Chun
4,269,004 A 5/1981 Schiebroek
4,297,820 A 11/1981 Artzer
4,416,096 A 11/1983 Schuster et al.
4,478,895 A 10/1984 Makami et al.
4,494,348 A 1/1985 Kastelic
4,498,941 A 2/1985 Goldsworthy
4,505,208 A 3/1985 Goldman
4,558,552 A 12/1985 Reitter, II
4,562,666 A 1/1986 Young, III
4,616,456 A 10/1986 Parker
4,625,484 A 12/1986 Oboler
4,628,661 A 12/1986 St. Louis
4,640,074 A 2/1987 Paakkinen
4,646,498 A 3/1987 Schneller et al.
4,664,967 A 5/1987 Tasdemiroglu
4,730,023 A 3/1988 Sato et al.
4,731,972 A 3/1988 Anderson
4,732,803 A 3/1988 Smith, Jr.
4,780,351 A 10/1988 Czempoyesh
4,822,657 A 4/1989 Simpson
4,842,923 A 6/1989 Hartman
4,877,656 A 10/1989 Baskin
4,911,062 A 3/1990 Heyman
4,970,838 A 11/1990 Phillips
5,032,466 A 7/1991 Cappa
5,037,690 A 8/1991 van der Kooy
5,076,168 A 12/1991 Yoshida et al.
5,104,726 A 4/1992 Ross
5,124,195 A 6/1992 Harpell et al.
5,190,802 A 3/1993 Pilato
5,200,256 A 4/1993 Dunbar
5,242,207 A 9/1993 Carson et al.
5,249,534 A 10/1993 Sacks
5,316,839 A 5/1994 Kato et al.
5,347,775 A 9/1994 Santos
5,402,703 A 4/1995 Drotleff
5,447,765 A 9/1995 Crane
5,463,929 A * 11/1995 Mejia ..... 89/36.02
5,480,955 A 1/1996 Primeaux, II
5,487,248 A 1/1996 Artzer
5,517,894 A 5/1996 Bohne et al.
5,522,194 A 6/1996 Graulich
5,524,412 A 6/1996 Corl
5,563,364 A 10/1996 Alhamad
5,576,511 A 11/1996 Alhamad
5,582,906 A 12/1996 Romesberg et al.
5,591,933 A 1/1997 Li et al.
5,647,180 A 7/1997 Billings et al.
5,649,398 A 7/1997 Isley, Jr. et al.
5,655,343 A 8/1997 Seals
5,681,408 A 10/1997 Pate et al.
5,681,612 A 10/1997 Benedict et al.
5,744,221 A 4/1998 Crane et al.
5,749,178 A 5/1998 Garmong
5,761,864 A 6/1998 Nonoshita
5,789,327 A 8/1998 Rousseau
5,811,719 A 9/1998 Madden, Jr.
5,813,174 A 9/1998 Waller
5,822,940 A 10/1998 Carlin et al.
5,833,782 A 11/1998 Crane et al.
5,937,595 A 8/1999 Miller
5,962,617 A 10/1999 Slagel
6,012,260 A * 1/2000 Hendrick et al. ..... 52/302.1
6,034,155 A 3/2000 Espeland et al.
6,099,768 A 8/2000 Strickland et al.
6,112,489 A 9/2000 Zweig
6,161,462 A 12/2000 Michaelson
6,176,920 B1 1/2001 Murphy et al.
6,212,840 B1 4/2001 Davidovitz
6,269,597 B1 8/2001 Haas
6,298,607 B1 * 10/2001 Mostaghel et al. ..... 52/1
6,298,766 B1 10/2001 Mor
6,298,882 B1 10/2001 Hayes et al.
6,309,732 B1 10/2001 Lopez-Anido et al.
6,314,858 B1 11/2001 Strasser et al.
6,439,120 B1 8/2002 Bureaux et al.
6,455,131 B2 9/2002 Lopez-Anido et al.
6,460,304 B1 10/2002 Kim
6,469,304 B2 10/2002 Hewitt et al.
6,503,855 B1 1/2003 Menzies et al.
6,524,679 B2 2/2003 Hauber et al.
6,543,371 B1 4/2003 Gardner
6,548,430 B1 4/2003 Howland
6,703,104 B1 3/2004 Neal
6,718,722 B2 4/2004 Worrell et al.
6,745,535 B2 6/2004 Nordgren et al.
6,806,212 B2 10/2004 Fyfe
6,820,381 B1 11/2004 Ballough
6,898,907 B2 5/2005 Diamond
6,899,009 B2 5/2005 Christiansen et al.
6,907,811 B2 6/2005 White
6,927,183 B1 8/2005 Christen
7,067,592 B2 6/2006 Chino et al.
7,138,175 B2 11/2006 Saito
7,148,313 B2 12/2006 Koga et al.
7,189,456 B2 3/2007 King
7,886,651 B2 * 2/2011 Hall ..... 89/36.02
8,316,613 B2 * 11/2012 Hall ..... 52/745.16
2002/0058450 A1 5/2002 Yeshurun et al.
2002/0160144 A1 10/2002 Higgins et al.
2002/0184841 A1 12/2002 Diamond
2003/0003252 A1 1/2003 Yun et al.
2003/0037586 A1 2/2003 Durney
2003/0096072 A1 5/2003 Johnson
2003/0104738 A1 6/2003 Porter
2003/0129900 A1 7/2003 Chiou
2003/0148681 A1 8/2003 Fyfe
2003/0159390 A1 8/2003 Fonseca
2003/0167911 A1 9/2003 White
2003/0188498 A1 10/2003 Lewkowitz
2003/0199215 A1 10/2003 Bhatnagar et al.
2003/0233808 A1 12/2003 Zuppan
2004/0123541 A1 7/2004 Jewett
2004/0147191 A1 7/2004 Wen
2004/0161989 A1 8/2004 Dennis et al.
2004/0166755 A1 8/2004 Bergmans et al.
2005/0204696 A1 9/2005 Hall
2005/0262999 A1 12/2005 Tomczyk et al.
2006/0037463 A1 2/2006 Vittoser et al.
2006/0265985 A1 11/2006 Nichols
2008/0092730 A1 4/2008 Hall
2008/0092731 A1 4/2008 Hall

FOREIGN PATENT DOCUMENTS

GB 1582539 A1 1/1981
JP 59146847 8/1984
JP 62273827 11/1987
JP 2274534 11/1990

(56) References Cited

FOREIGN PATENT DOCUMENTS

| | | |
|---|---|---|
| JP | 6129137 | 5/1994 |
| WO | WO 0033015 | 6/2000 |
| WO | WO 200492495 | 10/2004 |

OTHER PUBLICATIONS

International Application No. PCT/US05/039619—PCT Written Opinion of the International Searching Authority and International Search Report mailed Sep. 21, 2006.
International Application No. PCT/US05/042983—PCT Written Opinion of the International Searching Authority and International Search Report mailed Sep. 13, 2007.
International Application No. PCT/US06/034188—PCT Written Opinion of the International Searching Authority and International Search Report mailed Sep. 24, 2007.
Australian Patent Application No. 2004230631—Office Action (now abandoned) Examiner's First Report mailed Jan. 30, 2009.
Chinese Patent Application No. 2004800157252—Office Action (now abandoned) First Office Action mailed Nov. 9, 2007.
European Patent Application No. 04 759 137.5—Office Actions (now abandoned) Supplementary European Search Report mailed Jul. 10, 2007.
European Patent Application No. 04 759 137.5—Office Actions (now abandoned) Examination Report mailed Feb. 25, 2009.
European Patent Application No. 05 846 915.6—Office Action (now abandoned) Extended European Search Report mailed Jan. 29, 2009.
Indian Patent Application No. 4877/Delnp/2005—Office Action (now Indian Patent No. 233186 granted Mar. 27, 2009) First Examination Report mailed Jan. 7, 2008.
Singapore Patent Application No. 200506573-5—Office Actions Australian Patent Office Written Opinion and Search Report mailed May 22, 2008.
Singapore Patent Application No. 200506573-5—Office Actions Australian Patent Office Written Opinion mailed Feb. 26, 2009.
Singapore Patent Application No. 200506573-5—Office Actions Australian Patent Office Examination Report mailed by IPOS (Intellectual Property Office of Singapore) on Jan. 11, 2010.
Singapore Patent Application No. 200703931-6—Office Actions Australian Patent Office Written Opinion mailed Aug. 28, 2008.
Singapore Patent Application No. 200703931-6—Office Actions Australian Patent Office Examination Report mailed Jun. 2, 2009.
U.S. Appl. No. 10/510,691 The MSDS HyperGlossary: Distance Unit Conversions—http://www.ilip.com/msds/ref/distanceunits.html, dated Oct. 4, 2006.
U.S. Appl. No. 10/510,691—Final Office Action mailed Aug. 10, 2011.
U.S. Appl. No. 10/510,691—Final Office Action dated Mar. 3, 2010.
U.S. Appl. No. 11/289,511—Final Office Action mailed May 27, 2011.
U.S. Appl. No. 11/289,511—Non-Final Office Action mailed Sep. 13, 2010.
Australian Patent Application No. 2005302160—Office Action (now abandoned) Examiner's First Report dated May 5, 2010.
European Patent Application No. 05858691.8 - Office Action (now abandoned) Extended European Search Report dated Jan. 13, 2010.
U.S. Appl. No. 12/711,501—Non-Final Office Action dated Aug. 24, 2010.
U.S. Appl. No. 11/289,511 Non-Final Office Action mailed Dec. 15, 2008.
U.S. Appl. No. 10/510,691 Non-Final Office Action mailed Mar. 13, 2009.
U.S. Appl. No. 11/289,511 Final Office Action mailed Aug. 20, 2009.
U.S. Appl. No. 11/264,752, Notice of Allowance dated Oct. 27, 2009.
U.S. Appl. No. 11/264,752, Final Office Action mailed Dec. 22, 2008.
U.S. Appl. No. 11/264,752, Notice of Allowance mailed Apr. 20, 2009.
PCT/US05/42983 Written Opinion of the International Searching Authority and international Search Report mailed Sep. 13, 2007.
PCT/US05/39619 Written Opinion of the International Searching Authority mailed Sep. 21, 2006.
Indian Patent Application No. 4877/DELNP/2005—First Examination Report mailed Jan. 7, 2008.
Singapore Application/Patent No. 0703931-6—Australian Patent Office Written Opinion mailed Aug. 28, 2008 U.S. Appl. No. 12/711,501—Final Office Action mailed May 12, 2011.
EP Communication enclosing EP 04 75 9137 Supplementary European Search Report dated Jul. 3, 2007.
Office Action in U.S. Appl. No. 10/510,691 dated Apr. 27, 2006.
Office Action in U.S. Appl. No. 10/510,691 dated Oct. 12, 2006.
Office Action in U.S. Appl. No. 10/510,691 dated Dec. 27, 2006.
Office Action in U.S. Appl. No. 10/510,691 dated Mar. 9, 2007.
Office Action in U.S. Appl. No. 10/510,691 dated Mar. 30, 2007.
Office Action in U.S. Appl. No. 10/510,691 dated Jun. 29, 2007.
Office Action in U.S. Appl. No. 11/264,752 dated Jul. 25, 2006.
Office Action in U.S. Appl. No. 11/264,752 dated Feb. 26, 2007.
Office Action in U.S. Appl. No. 11/264,752 dated Jun. 7, 2007.
Office Action in U.S. Appl. No. 11/264,752 dated Sep. 20, 2007.
WIPO Communication enclosing PCT/US06/34188 International Search Report and Written Opinion dated Sep. 24, 2007.

* cited by examiner

SHRAPNEL CONTAINMENT SYSTEM AND METHOD FOR PRODUCING SAME

CROSS REFERENCE TO RELATED APPLICATIONS

This application is a continuation of U.S. patent application Ser. No. 10/510,691, filed Oct. 8, 2004 now U.S. Pat. No. 8,316,613, entitled "Shrapnel Containment System and Method for Producing Same," which is a U.S. National Phase Application of International Application No. PCT/US2004/010488, filed Apr. 6, 2004, entitled "Shrapnel Containment System and Method for Producing Same," which claims priority to U.S. Provisional Patent Application No. 60/460,422, filed Apr. 7, 2003, entitled "Blast-Resistant Panel and Method for Producing Same."

BACKGROUND OF THE INVENTION

1. Field of the Invention

The present invention relates to a system to be installed at an interior of a building wall to contain shrapnel from a blast, and a method for producing such systems.

2. Description of Related Art

In the aftermath of recent terrorist attacks, in which buildings have been targeted for destruction, increased attention has been paid to improving the safety of workers inside such buildings, should further attacks be forthcoming. It has been determined that a main source of damage to articles and injury to persons inside of a building under attack is not necessarily the initial blast of an impact or explosion against the building, but instead is the flying shrapnel (pieces of the building wall) generated by the blast.

It has been determined that improvements in containing this shrapnel can be accomplished by spraying a polymeric liner onto the interior surface of the structural wall of a building. A polymer proposed for this application is a polyurethane material that is sprayed directly onto an interior surface of the structural wall. In existing buildings, this liner would be applied by removing any interior cosmetic wall surface (e.g., drywall), applying the spray coating, and reinstalling the cosmetic wall surface. In new buildings, the liner would be sprayed onto the interior of the structural wall prior to the interior finish work being performed.

The in situ spraying of such a liner is a relatively expensive process, and requires skilled equipment operators and careful containment of the area in which the spraying is being performed. In addition, the polyurethane material has a very rapid set or cure time, on the order of only a few seconds. Thus, when the polyurethane is inadvertently sprayed onto surfaces which are not intended to have a liner thereon, it can be very difficult to remove the material from such surfaces.

Polyurea coating materials are generally known for use in applications where corrosion resistance or abrasion resistance is needed or desired, or in certain waterproofing applications. Certain polyurea coatings also are tear and impact resistant.

It is accordingly a principal object of the present invention to provide a system which improves the safety of a building by providing shrapnel absorption and containment, and which provides improved containment of shrapnel generated from an impact or blast at the wall of a building.

SUMMARY OF THE INVENTION

The above and other objects of the present invention are achieved by producing pre-formed panels which are cut to size, as necessary, and installed onto the interior surface of a structural wall of a building. The panels are produced by spraying a polyurea or other elastomeric material specifically selected to facilitate the production process and the performance of the finished panels, in producing a material having improved elongation and tensile strength properties. Alternatively, the polyurea material or other elastomeric material may be applied and bonded directly to the interior surface of a structural wall or building.

elastomers such as polysiloxane, polyurethane and polyurea/polyurethane hybrids may be employed as an alternative to polyurea in constructing the panels or in bonding a layer or layers of the material directly to the wall.

The present invention also involves a method for producing shock-resistant panels, including spraying a two-part, high solids, polyurea elastomer material onto a releaseable substrate to a desired thickness, with or without fiber or fabric reinforcement, then allowing the material to cure, and removing the cured panel from the substrate. Panels are then delivered to a building site, and are installed at the interior of the structural walls of the building.

BRIEF DESCRIPTION OF THE DRAWINGS

The invention will be best understood by reading the ensuing specification in conjunction with the drawing figures, in which like elements are designated by like reference numerals, and wherein.

DETAILED DESCRIPTION OF THE PREFERRED EMBODIMENTS

Figure 2:
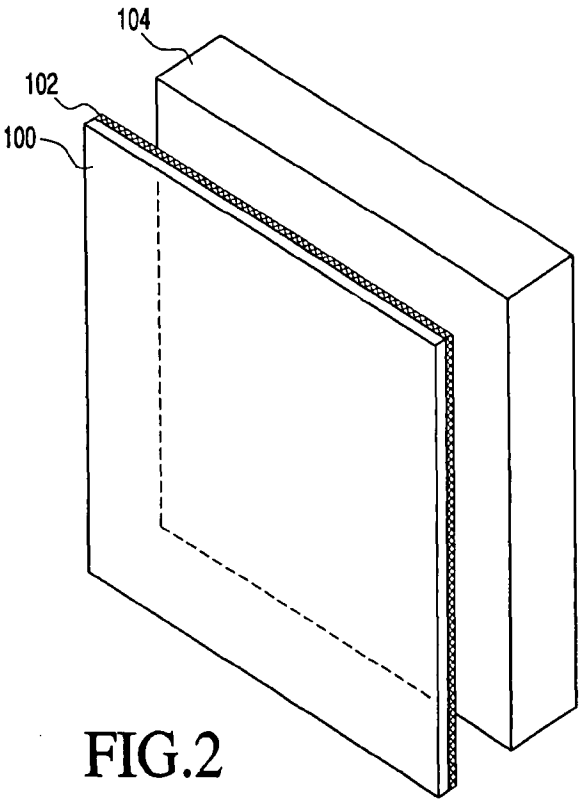
FIG. 2 is a substantially schematic view of the installation of a shrapnel containment panel at the interior of the structural wall of a building, in accordance with a preferred embodiment of the present invention.
Figure 1:
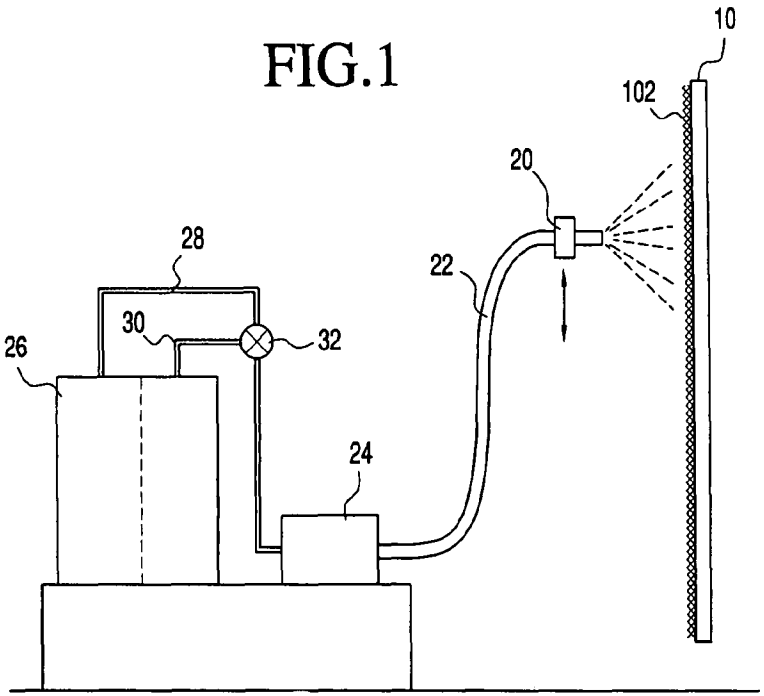
FIG. 1 schematically illustrates a panel production apparatus according to a preferred embodiment of the present invention.

As illustrated in FIG. 1, a panel substrate 10 is preferably provided as a mold surface onto which a polyurea elastomeric material may be sprayed in producing blast resistant or shrapnel-retarding panels 100 according to the preferred embodiment of the present invention. The substrate 10 may be treated, as necessary, with a release compound, in order to facilitate the removal of cured panels from the substrate.

Employing standard, known, spray application equipment, a two-part, high solids, elastomer composition is sprayed in liquid (uncured) form onto substrate 10. The spray equipment, for illustrative purposes, may include spray nozzle 20, which is connected via flexible tubing 22, to an application pump 24. Reservoir or storage tank 26 may be used to feed the components making up the elastomer composition through feed lines 28, 30, where the components are mixed at valve 32. Spray nozzle 20 may either be manually operated so as to apply the polyurea material over the entire substrate in producing a panel. Alternatively, the spray nozzle (more than one can be used may be mounted to a carriage (not shown) of a known construction that has drive means for moving the nozzle 20 transversely or horizontally, and vertically, to ensure that the composition is applied in an even thickness over the entire substrate. Other spray application arrangements are also feasible, and the one shown in FIG. 1 is but one example. It is envisioned that, for large scale production, the spray process will be substantially completely automated, with computer control and robotic elements being used to control the spray equipment, including the movement of the sprayers and delivery of the material to be sprayed, and the handling of the panels. The same basic process will, however, likely remain the same.

In a particularly preferred embodiment, the panels may further be enhanced by including a reinforcing layer 102 which may be disposed at either the outer or inner surface of the panel 100, or which may be disposed in the interior of the panel. The method of producing such a panel, with the reinforcing layer being at an interior of the panel, may preferably include placing a reinforcing fabric material against substrate 10, and spraying the polyurea or other sprayable elastomer onto the fabric to a thickness which is approximately one-half the thickness of the finished panel. The fabric 102 with the sprayed-on polyurea is then rotated or flipped such that the polyurea faces the substrate and the fabric 102 faces the spray equipment. A second application or spraying of the polyurea onto the opposite side of the fabric 102 is then effected, to produce a panel of the desired final or finished thickness.

Modifications to this preferred process sequence may be employed. The reinforcing layer can be placed in intimate contact with substrate 10 when it is desired to have the layer at an exterior surface of the panel 100, and the elastomer can be sprayed onto the layer until the desired panel thickness is attained. Where the layer 102 is to be in the interior of the panel 100, the layer may be spaced apart from the substrate 10, with the polyurea being sprayed through the layer to encapsulate the layer 102. Alternatively, a portion of the panel may be sprayed onto the substrate, and the layer 102 is then introduced, and the remaining thickness of the panel is then sprayed to complete the panel.

Once the spray process is completed, and the polyurea material has either partially or fully cured, the layer is separated from the substrate 10, and thus forms a panel 100.

The panels 100 may thus be essentially mass-produced in an economical manner. This can be accomplished in a true factory setting, or in a portable or makeshift production facility constructed at a building site, if that were found to be comparably economical or desirable for any reason. Panels 100 are then transported to a building which is to be outfitted with these blast-resistant panels.

Interior structural walls 104 of a building to which the panels are to be secured are either left exposed during initial construction or, in a building retrofit, the cosmetic interior wall surfaces are removed to expose the interior surface of the structural wall. The panels 100 are cut to size, as necessary, and are affixed to the interior surface of the wall 104, preferably using any suitable adhesive, or by mechanical attachment. Because the structural wall 104 will commonly be formed either of block or poured concrete, suitable mechanical forms of attachment may include threaded concrete wall anchors, or screw and anchor sets, or nailing with an appropriate concrete-penetrating nail.

Figures 3, 4, 5, 6:
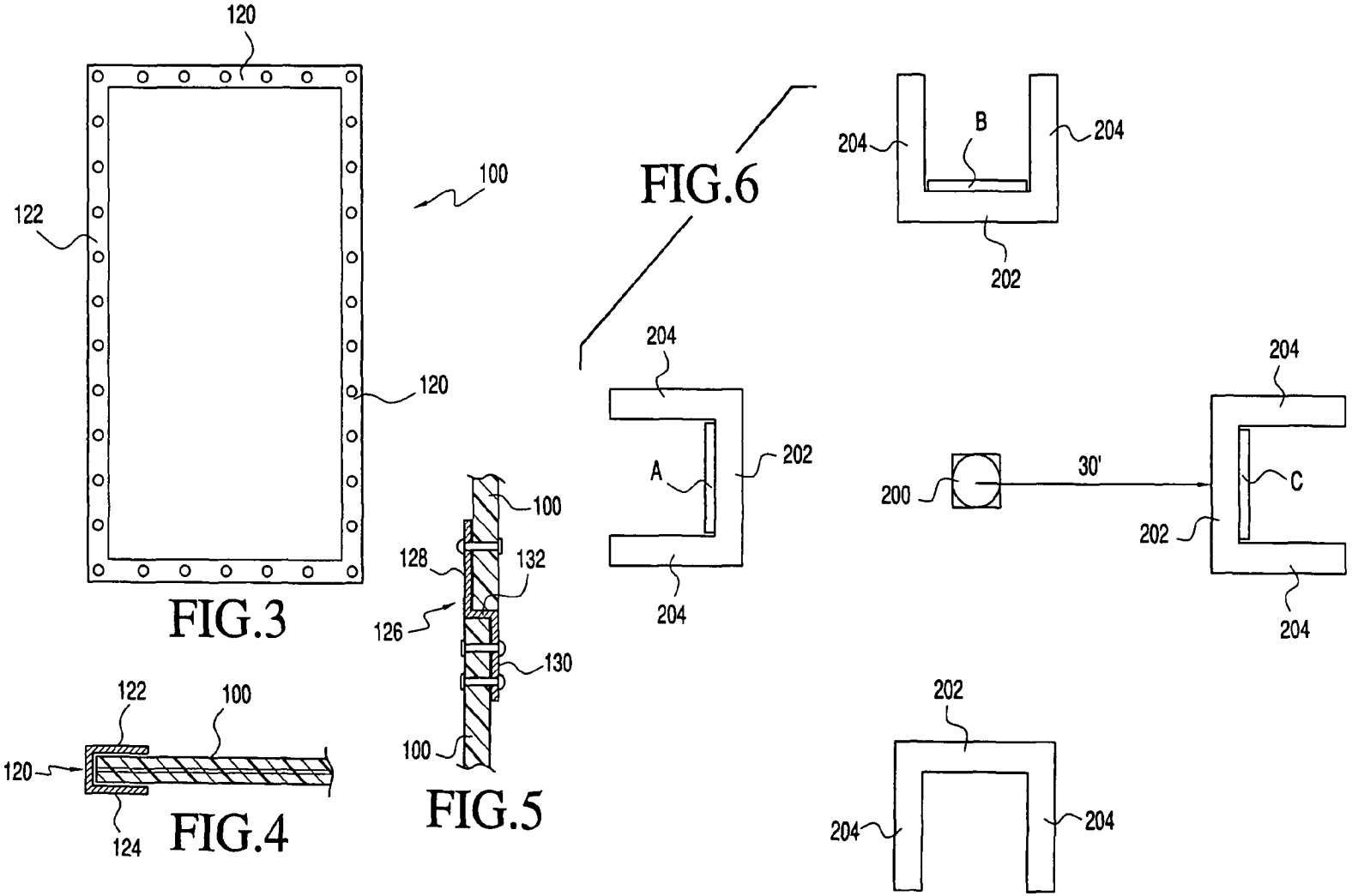
FIG. 3 illustrates a shrapnel containment panel in accordance with a preferred embodiment of the present invention.
FIG. 4 is a cross-sectional view of a panel having a channel member secured at its proiphery.
FIG. 5 is a cross-sectional view of two abutting panels joined at their edges by a panel fastening member according to a preferred embodiment of the present invention.
FIG. 6 is an overhead substantially schematic view of the test layout conducted in accordance with the development of the present invention.

FIG. 3 illustrates a preferred embodiment of the panel 100 as it is readied for installation. In this embodiment, panel 100 is bounded at its periphery by channel members 120 which retain the edges of the panel 100 between two rails 122, 124 positioned at opposite sides (e.g., front and back) of the panel. (see FIG. 4) The channel members, which are preferably made of stainless steel, aid in structurally reinforcing the panels at the edges, adding stiffness thereto. In addition the use of channels at the edges of the panel improves the reliability of mechanical fasteners, such as concrete wall anchors, in securing the panels to the building walls.

FIG. 5 illustrates a further panel fastening member 126 suitable for use when two panels are to be joined to span a distance wider than the width of a single panel. Adjacent edges of two panels are secured to the two rails 128, 130 of this panel fastening member using suitable mechanical fasteners. The rails 128, 130 are offset by a web 132, such that the fastening member retains the two panels in essentially an edge-abutting relationship. The fastening member 126 may be used in addition to, or in lieu of, the channel member 120 at the edges to be joined. The fastening member can be secured to the building wall, as well, by appropriate mechanical fasteners.

An explosive blast, or other type of impact force at the exterior of a building, can cause the structural wall to fracture and generate wall fragments of varying sizes, which are generally referred to as shrapnel. The panels 100, with their improved elongation and tensile strength characteristics, will act to effectively absorb a significant portion of the kinetic energy imparted to the pieces of shrapnel. This absorption of kinetic energy will prevent the shrapnel from flying through the interior of the building. In situations in which the explosive blast also causes the panels 100 to fracture, the kinetic energy absorbed or dissipated by the panels will significantly reduce the amount and/or speed of the shrapnel that may enter the interior of the building. Persons inside the building are thus better protected against a principal cause of injury resulting from an attack on a building.

The panels are also believed to contribute to the structural integrity of the wall itself, particularly when fastened to the wall by mechanical fasteners at the periphery of the panels.

In order to be effective at absorbing or dissipating the potentially high levels of kinetic energy that may come from an explosion or other concussive event, it is preferred that the panel thickness be in the range of about 100 to about 250 mil. Even more preferably, the panel thickness will be about 180 mil. Panels thicker than 250 mil may also be used, however, it is expected that the possible incremental increase in shrapnel containment or blast resistance afforded by the thicker panels may be outweighed by the increased cost (material cost), in a cost/benefit analysis.

The elastomeric material employed in the shrapnel-containing panels preferably has particular combinations of physical or other material properties in its cured state. Of particular significance are percent elongation at break and tensile strength. The elastomer preferably will have an elongation at break in a range between about 100-800%, and more preferably at the higher end of this range, e.g., 400-800%. The tensile strength of the elastomer is preferably a minimum of 2000 psi.

In addition, the adhesion properties of the elastomer are believed to be important, whether the panels are constructed separately or are formed in place on the walls of the building or other structure to be protected. It is preferred that the elastomer exhibit an adhesion to concrete of 300 psi minimum (or at concrete failure), and an adhesion to steel of 1200 psi minimum.

As noted previously, polyurea, polysiloxane, polyurethane and polyurea/polyurethane hybrids can produce the desired physical and material properties. Currently, a particularly preferred elastomer is marketed as Envirolastic® AR425, a 100% solids, spray-applied, aromatic polyurea material, marketed by the General Polymers division of Sherwin-Williams Company. This material is available as a two-part (isocyanate quasi-polymer; amine mixture with pigment), sprayable material designed principally as a flexible, impact resistant, waterproof coating and lining system.

The Envirolastic® AR425 system has been tested in panels produced having a fabric reinforcement layer. The fabric reinforcement layer provides a framework to which the uncured elastomer will adhere in forming a panel shape. The fabric reinforcement will preferably also contribute to the structural integrity of the panel in resisting blast and in containing shrapnel, particularly in helping restrict the amount of elongation experienced by the elastomer as the energy of the blast or other impact is being absorbed.

To date, the fabrics that have been used in producing panels for testing are produced from aramid or polyester yarns or fibers, with an open grid (opening between warp and fill yarns) on the order of 0.25 in. by 0.25 in., or 0.5 in. by 0.25 in. Smaller or larger grid opening sizes are, however, believed to be suitable for use. The tensile strength of the fabric employed in panels tested to date is on the order of 1200 psi by 1200 psi. Fabric made from Technora and Twaron-brand aramid yarns or fibers produced by Teijin Fibers are believed to be particularly suitable for use in this application.

The shrapnel containment system and method of the present invention can also be in the form of a layer of the elastomeric material applied and bonded directly to the wall or other structure that is to be reinforced. In this instance, the wall would preferably be cleared of loose and foreign materials, with the elastomer applied by spraying, in a manner similar to that employed in spraying the panels onto the panel substrate. The elastomer, as noted above, will preferably be selected to have a bonding strength or adhesion to concrete of 300 psi minimum, and the concrete will generally have a sufficient number of small surface irregularities such that the elastomer will find regions where mechanical attachment enhances the adhesion.

When the system is to have a fabric or fiber reinforcing element, the elastomer may also preferably be partially applied, with the reinforcing element then being positioned, and the remainder of the elastomer layer is then spray-applied. Alternatively, the reinforcing element could first be positioned against the wall, with the entire thickness of the elastomer layer then being applied thereto.

EXAMPLES

Testing of blast-resistant/shrapnel-containment panels in accordance with the present invention have been conducted. The physical test layout (not to scale) is shown in a schematic overhead view in FIG. 6. In FIG. 6, an explosive charge 200 was positioned centrally to four (4) identically constructed concrete block masonry target walls 202, spaced on a 30' radius circle from the explosive. The masonry target walls 202 were constructed having two reinforcing legs 204, which together with the target walls formed a squared-off "U" shape, such that the target walls 202 facing the explosive charge would have some degree of structural reinforcement, as they generally would in a building.

Panels A, B, and C (thickness not to scale relative to wall thickness) were installed at the interior of three of the walls, while the fourth wall had no panel or lining installed. The panels included stainless steel channels 120 surrounding their peripheries, and were secured to the interior of the walls 202 using concrete anchor fasteners.

All of Panels A, B and C were produced at a nominal thickness of 180 mil of polyurea material (Envirolastic® AR425) having a fabric reinforcement layer disposed therein. Further constructional details of the panels are as follows:

TABLE I

| Panel | Elastomer | Fabric Reinforcement |
|---|---|---|
| A | AR425, 180 mil | Technora T200 fabric, 0.5 × 0.25" grid opening |
| B | AR425, 180 mil | Technora T200 fabric, 0.5 × 0.25" grid opening |
| C | AR425, 180 mil | Twaron T1000 fabric, 0.25 × 0.25" grid opening |

The explosive charge 200 comprised 42 blocks (52.5 lbs.) of C-4 explosive configured to generate a uniform blast overpressure on the face of each target wall 202. This quantity of C-4 explosive is equivalent to 67.2 pounds of TNT. The charge was elevated four feet above the ground to align it with the center point of each wall (walls 202 were 8 feet in height). The explosive charge was statically detonated, creating a peak incident overpressure of 17.67 psi, and a reflected pressure of 51.22 psi.

Initial post-explosion observations revealed that the unprotected wall (no panel secured to interior) suffered catastrophic structural failure, with virtually none of the concrete of either the target wall 202 or the reinforcing legs 204 remaining in place above the base of the wall. Fragments of the wall, or shrapnel, caused by the blast were found up to 54 feet behind the wall (i.e., to the interior of the wall).

In contrast, the three target walls having the panels installed at the interior surface remained standing, with somewhat varying levels of damage to the concrete blocks. Regions at which the target wall 202 was joined to reinforcing legs 204 appeared to suffer the most damage, due to the stresses induced at those joints by the blast. The target walls themselves contained varying degrees of cracking and fracture.

Inspection of the panels revealed that small areas of a marking paint coating on the interior surfaces of the panel had spalled or been knocked, off, presumably by concrete fragments impacting the opposite side of the panel during the explosion. Little or no plastic deformation, and no fracture or perforation, of the panels was observed. No concrete fragments were found behind (to the interior of) the panels.

Upon removal of the panels, fragments of the target walls were found behind each of the test panels. Tables 2-5 present data relating to wall fragments (shrapnel) found subsequent to the test. It is to be noted that no data is provided relative to "Distance from Wall" for the walls having the panels secured thereto, in that none of the fragments passed through the panels.

TABLE 1

Fragments found behind the Baseline target wall

| Fragment No. | Mass (oz) | Distance from wall (ft) |
|---|---|---|
| 1 | 1.0 | 49 |
| 2 | .4 | 45.2 |
| 3 | .3 | 54 |
| 4 | .1 | 41.5 |
| 5 | .3 | 41 |
| 6 | 1.7 | 33 |
| 7 | 13.0 | 30 |
| 8 | 1.5 | 24.4 |
| 9 | 1.1 | 19 |
| 10 | 3.4 | 19 |
| 11 | .5 | 18.5 |

TABLE 1-continued

| Fragments found behind the Baseline target wall | | |
|---|---|---|
| Fragment No. | Mass (oz) | Distance from wall (ft) |
| 12 | 6.7 | 19 |
| 13 | .1 | 19 |

TABLE 2

| Fragments contained by Test panel T1402 | |
|---|---|
| Fragment No. | Mass (oz) |
| 1 | .9 |
| 2 | 1.1 |
| 3 | 1.1 |
| 4 | .2 |
| 5 | .1 |

TABLE 3

| Fragments contained by Test panel T1403 | |
|---|---|
| Fragment No. | Mass (oz) |
| 1 | .5 |
| 2 | .2 |
| 3 | 1.2 |
| 4 | .3 |
| 5 | .1 |
| 6 | .1 |
| 7 | 2.1 |
| 8 | .6 |

TABLE 4

| Fragments contained by Test panel T1404 | |
|---|---|
| Fragment No. | Mass (oz) |
| 1 | .8 |
| 2 | 1.3 |
| 3 | 5.2 |

It can thus be seen that the present invention provides an economical means of greatly enhancing the safety of workers and/or equipment or other objects located inside a building or other structure which is subjected to an explosive blast or other form of large impact, which would otherwise send shrapnel of pieces of the wall projecting through the interior of the structure. The system of the present invention can readily be retrofitted into existing buildings and structures, especially when the pre-sprayed panel version is employed, or can be installed in any new building or structure being constructed. The finished interior wall may have an appearance substantially identical to an interior wall not outfitted with the system of the present invention, and thereby no compromise is made with regard to workplace aesthetics.

While principally disclosed as being useful in shielding the interior of a wall and containing shrapnel therefrom in the event of a blast or other impact, the system and method of the present invention, particularly the system in panel form, is believed to provide high levels of resistance to penetration therethrough in more focused or localized impact situations. As such, the panels or the system are expected to be suitable for use as armor "plate" in applications that require energy absorption and resistance to penetration against, for example, generally smaller projectiles fired by rifles and other firearms and guns, including use in defeating or defending against projectiles that are designed to be "armor-piercing" in nature. This property is regarded herein as being encompassed by the terms, "blast resistant", and as used for "shrapnel containment", as those terms are employed herein.

The foregoing description has been provided for illustrative purposes. Variations and modifications to the embodiments described herein may become apparent to persons of ordinary skill in the art upon studying this disclosure, without departing from the spirit and scope of the present invention.

The invention claimed is:

1. A blast-resistant panel, comprising:

only a single cured layer of a sprayed elongatable elastomeric material having only a single elongatable layer of a predetermined thickness in the range of about 100 mil to less than 250 mil and a percent elongation at break in a range of about 100-800%, the cured single elongatable layer of the elastomeric material having substantially entirely exposed front and back sides, and fastener elements for securing said single elongatable cured layer only to an interior side of an exterior wall of a building so that the cured, elongatable layer extends from at least two opposing edges of the interior side of the exterior wall of said building with a first of said opposing edges abutting a top of an outer perimeter of the interior side of the exterior wall of said building and a second of said opposing edges abutting a bottom of the outer perimeter of the interior side of the exterior wall of said building, said blast-resistant panel being configured to withstand an explosive blast having a peak incident overpressure of about 17 psi or more and a reflected pressure of about 51 psi or more measured at an exterior side of the exterior wall of said building without breaking.

2. A blast-resistant panel as set forth in claim 1, wherein the elastomeric material is a material selected from the group consisting of polyurea; polysiloxane; polyurethane; and a polyurea/polyurethane hybrid.

3. A blast-resistant panel as set forth in claim 1, wherein said elastomeric material is polyurea.

4. A blast-resistant panel as set forth in claim 1, further comprising a channel member secured to said panel around at least a portion of a periphery thereof by said fastener elements.

5. A blast-resistant panel as set forth in claim 1, wherein the blast-resistant panel has a thickness of about 180 mil.

6. A blast-resistant panel as set forth in claim 1, wherein said elastomeric material has a percent elongation at break in a range of about 400-800%.

7. A blast-resistant panel as set forth in claim 1, wherein said panel further comprises a fabric reinforcing layer.

8. A blast-resistant panel as set forth in claim 3, wherein said panel further comprises a fabric reinforcing layer.

9. A blast-resistant panel as set forth in claim 8, wherein said fabric reinforcing layer is constructed of aramid fibers.

10. A blast-resistant panel as set forth in claim 8, wherein said fabric reinforcing layer is constructed of polyester fibers.

11. A blast-resistant panel as set forth in claim 1, wherein said fastener elements for securing said elongatable blast-resistant panel only to an interior side of the exterior wall of said building comprise concrete anchors.

12. A system for improving the blast resistance of a structure, comprising:

one or more flexible, blast-resistant panels of only a single cured layer of an elongatable elastomeric material having only a single elongatable layer of a predetermined thickness in a range between about 100 mil and less than 250 mil and constructed of an elastomeric material sprayed onto a fabric reinforcing layer, and each of the flexible, blast-resistant panels having substantially entirely exposed front and back sides, said one or more flexible, blast-resistant panels having a steel channel fastened around a periphery thereof; and a plurality of fasteners adapted to fasten said steel channel and said one or more flexible, blast-resistant panels only to an interior side of an exterior wall of said structure so as to cover the interior side of the exterior wall of said structure from a top of an outer perimeter of the interior side of the exterior wall to a bottom of the outer perimeter of the interior side of the exterior wall and from a left side of the outer perimeter of the interior side of the exterior wall to a right side of the outer perimeter of the interior side of the exterior wall with said one or more flexible, blast-resistant panels, said one or more flexible, blast-resistant panels being configured to withstand an explosive blast having a peak incident overpressure of about 17 psi or more and a reflected pressure of about 51 psi or more without breaking.

13. The system of claim 12 wherein said steel channel comprises:

a pair of opposing sides depending from opposite ends of a bottom portion to form a substantially "U" shaped channel.

14. The system of claim 13 wherein said steel channel comprises:

a "U" shaped steel channel along a top portion, a bottom portion, and a first side portion of the periphery; and a "Z" shaped steel channel along a second side portion of the periphery opposite of the first side portion and between the top and bottom side portions, said "Z" shaped steel channel to be fastened to a first and a second of said one or more flexible, blast-resistant panels.

15. A system for improving penetration resistance of a structure, the system comprising:

only a single flexible, blast-resistant panel of a sprayed elastomeric material having only a single elongatable layer of a predetermined thickness in the range of about 100 mil to less than 250 mil, and the flexible, blast-resistant panel having substantially entirely exposed front and back sides;

a channel attached around a periphery of the flexible, blast-resistant panel; and a plurality of fasteners to fasten said channel only to an interior side of an exterior wall of said structure, the flexible, blast-resistant panel sized to extend across and cover an area between opposing sides of the interior side of the exterior wall of said structure with a first of said opposing sides abutting a top of an outer perimeter of the interior side of the exterior wall of said structure and a second of said opposing sides abutting a bottom of the outer perimeter of the interior side of the exterior wall of said structure, said flexible, blast-resistant panel being configured to resist an explosive blast having peak incident overpressure of about 17 psi or more and a reflected pressure of about 51 psi or more, and said flexible, blast-resistant panel being to impede passage through said blast-resistant panel of wall fragments resulting from the explosive blast.

16. The system of claim 15 wherein said flexible, blast-resistant panel comprises a fabric reinforcing layer.

17. The system of claim 16 wherein said fabric reinforcing layer is constructed of at least one of aramid, polyester, yarns, and fibers.

18. The system of claim 16 wherein said fabric reinforcing layer comprises an open grid pattern.

19. The system of claim 16 wherein said plurality of fasteners to fasten said channel only to the interior side of an exterior wall of said structure comprise concrete anchors.

20. The system of claim 15 wherein said flexible, blast-resistant panel comprises an elastomeric material with a percent elongation at break in a range of about 100-800%.

* * * * *